US008944752B2

(12) United States Patent
Grelin

(10) Patent No.: US 8,944,752 B2
(45) Date of Patent: Feb. 3, 2015

(54) COMPRESSOR RECTIFIER ARCHITECTURE

(75) Inventor: Hervé Grelin, Villeblevin (FR)

(73) Assignee: Techspace Aero S.A., Milmort (BE)

( * ) Notice: Subject to any disclaimer, the term of this patent is extended or adjusted under 35 U.S.C. 154(b) by 629 days.

(21) Appl. No.: 13/169,935

(22) Filed: Jun. 27, 2011

(65) Prior Publication Data

US 2011/0318174 A1 Dec. 29, 2011

(30) Foreign Application Priority Data

Jun. 29, 2010 (EP) ..... 10167643

(51) Int. Cl.

| | |
|---|---|
| ***F01D 9/04*** | (2006.01) |
| ***F04D 29/54*** | (2006.01) |
| ***F01D 25/24*** | (2006.01) |
| ***F04D 29/64*** | (2006.01) |
| ***F04D 29/16*** | (2006.01) |

(52) U.S. Cl.

CPC ..... *F04D 29/542* (2013.01); *F01D 25/246* (2013.01); *F04D 29/644* (2013.01); *F05D 2250/71* (2013.01); *F04D 29/164* (2013.01)

USPC ..... 415/119; 415/209.4; 415/210.1

(58) Field of Classification Search

USPC ..... 415/119, 209.3, 209.4, 210.1, 214.1, 415/215.1

See application file for complete search history.

(56) References Cited

U.S. PATENT DOCUMENTS

| | | | | |
|---|---|---|---|---|
| 3,070,353 | A | 12/1962 | Welsh | |
| 4,643,636 | A * | 2/1987 | Libertini et al. | 415/138 |
| 4,820,120 | A * | 4/1989 | Feuvrier et al. | 415/189 |
| 4,907,946 | A * | 3/1990 | Ciokajlo et al. | 415/209.3 |
| 5,226,789 | A * | 7/1993 | Donges | 415/189 |
| 5,272,869 | A * | 12/1993 | Dawson et al. | 60/796 |
| 5,474,419 | A * | 12/1995 | Reluzco et al. | 415/209.4 |
| 5,494,404 | A | 2/1996 | Furseth et al. | |
| 5,690,469 | A * | 11/1997 | Deal et al. | 415/189 |
| 5,765,993 | A * | 6/1998 | Weiss | 415/209.2 |
| 6,595,747 | B2 * | 7/2003 | Bos | 415/209.4 |
| 6,991,427 | B2 * | 1/2006 | Scott | 415/209.3 |
| 2003/0206799 | A1 | 11/2003 | Scott | |
| 2007/0248455 | A1 * | 10/2007 | Workman et al. | 415/152.1 |
| 2008/0085187 | A1 * | 4/2008 | Bogue et al. | 415/208.1 |

FOREIGN PATENT DOCUMENTS

| | | |
|---|---|---|
| EP | 0 219 445 A1 | 4/1987 |
| EP | 0 616 110 A1 | 9/1994 |
| EP | 2 075 413 A1 | 7/2009 |

* cited by examiner

*Primary Examiner* — Liam McDowell

(74) *Attorney, Agent, or Firm* — Reinhart Boerner Van Deuren P.C.

(57) ABSTRACT

The present invention relates to a turbomachine rectifier comprising a plurality of stator vanes (5) connecting an inner collar (4) to an outer collar (3), each of said vanes (5) comprising a blade (11) and a blade-head platform (10), comprising an intermediate piece (6) arranged between the inner collar (4) and the outer collar (3) and fastened to the outer collar (3), said intermediate piece (6) comprising openings (14) for the passage of the vane blades (11) and said vane platforms (10) resting, on one side, on the outer collar (3) and, on the other side, on the intermediate piece (6).

15 Claims, 3 Drawing Sheets

COMPRESSOR RECTIFIER ARCHITECTURE

FIELD OF THE INVENTION

The present invention relates to the field of turbomachines. It more precisely relates to a rectifier architecture in an axial turbomachine compressor.

BACKGROUND OF THE INVENTION

Axial compressors are well known as such and are used in turbomachines, inter alia.

These low or high-pressure compressors comprise several stages of rotating vanes that are separated by fixed rectifier stages that aim to reposition the velocity vector of the fluid leaving the preceding stage before sending it to the following stage.

These rectifier stages are made up of fixed vanes, also called stator vanes, connecting an outer collar to an inner collar, both concentric and delimiting an air flow zone or aerodynamic vein. The rectifier may be made up of an assembly of several circular stages put on stage by stage or may be made up of a single-piece assembly directly incorporating several stages, possibly via a half-shell technology.

According to the state of the art, compressor rectifiers are made of a metal material (titanium, steel or aluminum) and the vanes within the rectifier are essentially made of a single material and have a single profile on a same stage. The outer collar ensures most of the mechanical functions. The inner collars as for them are relatively flexible, therefore not ensuring any structural function and imparting little stiffness to the system. The vanes are attached on the outer collars using various assembly technologies (welding, riveting, bolting) and are attached to the inner collars by a flexible joint (commonly of the silicone type).

AIMS OF THE INVENTION

The present invention aims to provide a solution that allows to overcome the drawbacks of the state of the art.

The present invention more particularly aims to provide a rectifier architecture that is more rigid than a conventional architecture while making it easier to disassemble.

The present invention also aims to provide a stiffened rectifier architecture allowing the use of stator vanes made according to different geometries and/or with different materials.

The present invention aims to provide a stiffened rectifier architecture without introducing significant aerodynamic disruptions within the rectifier.

A general aim of the invention is also to provide a rectifier architecture optimizing the requirements of mechanical strength, stiffness, mass, cost and repairability.

The present invention also aims to manufacture vaned rectifiers with a low mass and at a low cost for any compressor made up of a stator-type assembly jointly with a rotor of the type either with single-piece vaned discs, or with a drum, or others.

The present invention also aims to separate the interface functions with the other pieces (vane, abradable) ensured by the intermediate piece from the functions of resistance to fan blade out ensured by the collar.

BRIEF DESCRIPTION OF THE INVENTION

A first object of the present invention relates to a turbomachine rectifier comprising a plurality of stator vanes connecting an inner collar to an outer collar, each of said vanes comprising a blade and a blade-head platform, comprising an intermediate piece arranged between the inner collar and the outer collar and fastened to the outer collar, said intermediate piece comprising openings for the passage of the vane blades and said vane platforms resting, on one side, on the outer collar and, on the other side, on the intermediate piece.

According to specific embodiments of the invention, the rectifier comprises at least one or a suitable combination of the following features:

- the intermediate piece is in the form of a half-shell intended to integrate a plurality of stator vane stages;
- the intermediate piece comprises zones arranged between the stator vane stages and intended to receive the abradables of the outer collar;
- the intermediate piece is fastened to the outer collar at the level of the abradables and/or at the level of the assembly flanges between the outer collars and/or at the level of the platforms of the vanes;
- the fastening is achieved by means of fastening elements;
- these fastening elements are metal or composite;
- these fastening elements are rivets, lockbolts, bolts, or clips;
- the fastening is achieved by welding;
- it may also comprise a shock-absorbing joint arranged between the vane platform and the intermediate piece and/or between the vane platform and the outer collar;
- the absorbing joint is in the form of a half-ring and comprises openings for the passage of the vane blades;
- the stator vanes can be rigidly attached to the inner collar by means of fastening elements so as to impart increased rigidity to the rectifier;
- these fastening elements are metal or composite;
- these fastening elements are rivets, lockbolts, bolts or clips;
- it comprises metal and/or composite stator vanes;
- it comprises stator vanes with different geometries;
- the outer collar and the intermediate piece are made in a metal or composite material, respectively.

A second object of the present invention relates to a turbomachine comprising a rectifier as described above.

LEGEND

Figure 1A:
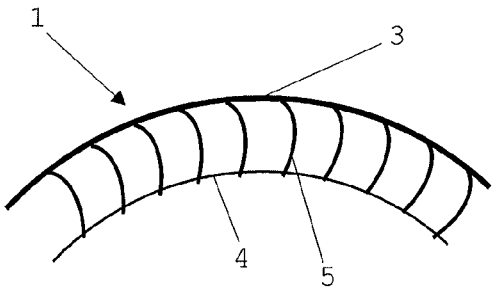
FIG. 1A PRIOR ART
FIG. 1A shows a diagrammatic view of the traditional construction of a rectifier as in the state of the art.

1. Traditional diagrammatic architecture of a rectifier as in the state of the art
2. Diagrammatic architecture of a rectifier as in the invention
3. Outer collar
4. Inner collar
5. Stator vane
6. Rectifier-support, also called vane-support, intermediate piece or collar-support
7. Abradable of the outer collar
8. Fastening element
9. Shock-absorbing joint

10. Platform of the blade head vane
11. Blade of the vane
12. Assembly flange between outer collars
13. Zone of the vane-support intended to receive the abradable of the outer collar
14. Opening
15. Abradable of the inner collar

DETAILED DESCRIPTION OF THE INVENTION

Figure 1B:
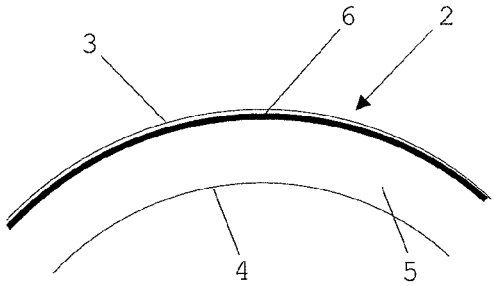
FIG. 1B shows a diagrammatic view of the architecture with a vane-support as in the invention.

The present invention relates to a new compressor rectifier architecture. In a traditional construction 1, as mentioned above and diagrammatically illustrated in FIG. 1 on the left, the structural function is solely ensured by the outer collar 3. The architecture as in the present invention 2 is made up, for its outer collar, of a structural collar 3 and of a non-structural collar-support 6, which will indifferently be called vane-support, rectifier-support or intermediate piece.

The invention is based on a fastening device between the different elements. Each of the rectifier stages is made up of a combination of vanes connected together by the stator head rectifier-support, a rectifier-support or an inner collar at the foot. The rigidity of the assembly is then provided to the head by the outer collar whereas the connection between the vanes is ensured by the vane-support.

Figure 2:
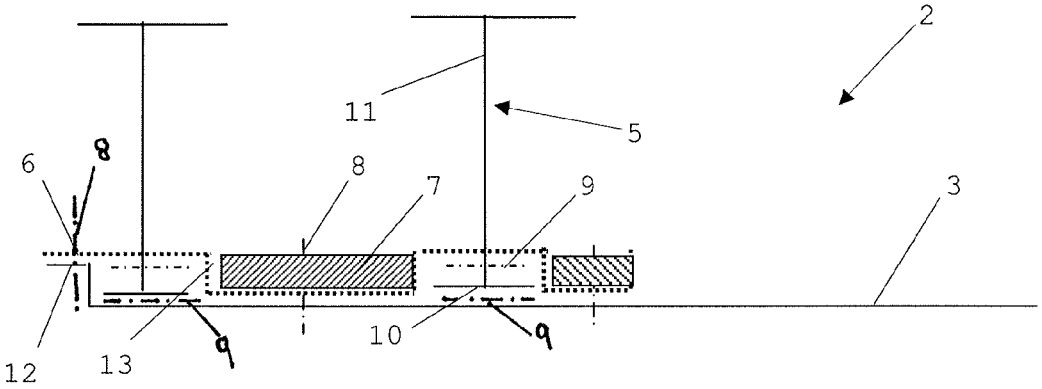
FIG. 2 shows a diagrammatic view, along the axis of the engine, of the rectifier as in the invention.
Figure 3:
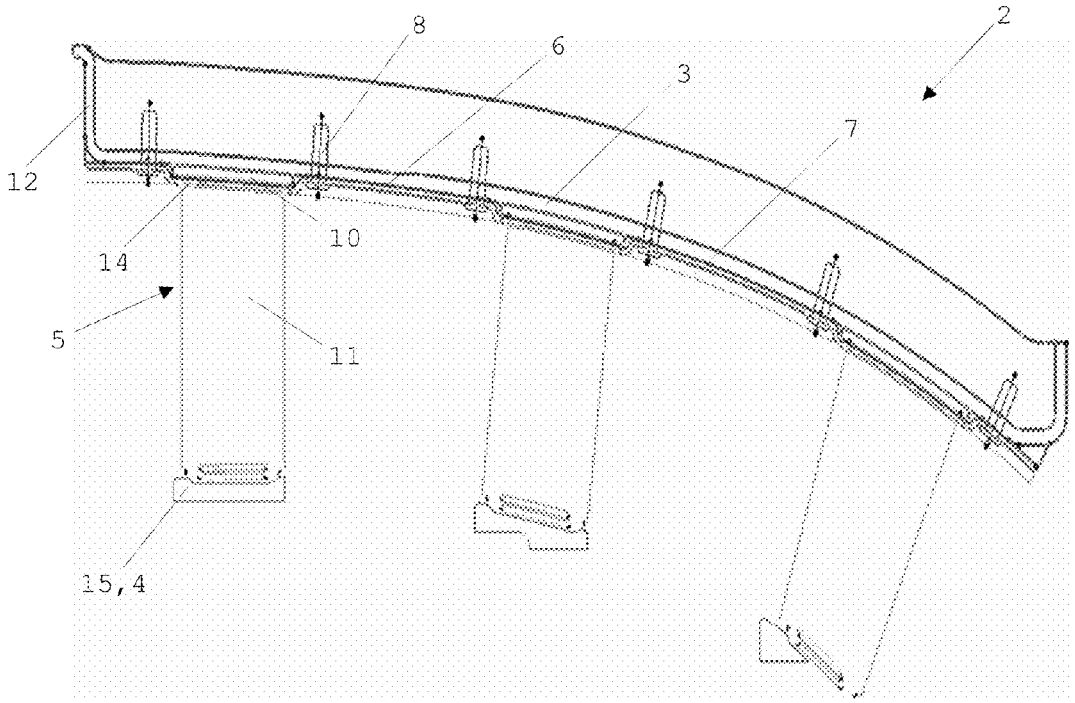
FIG. 3 shows a partial cross-section view, along the axis of the engine, of the rectifier as in the invention.
Figure 4:
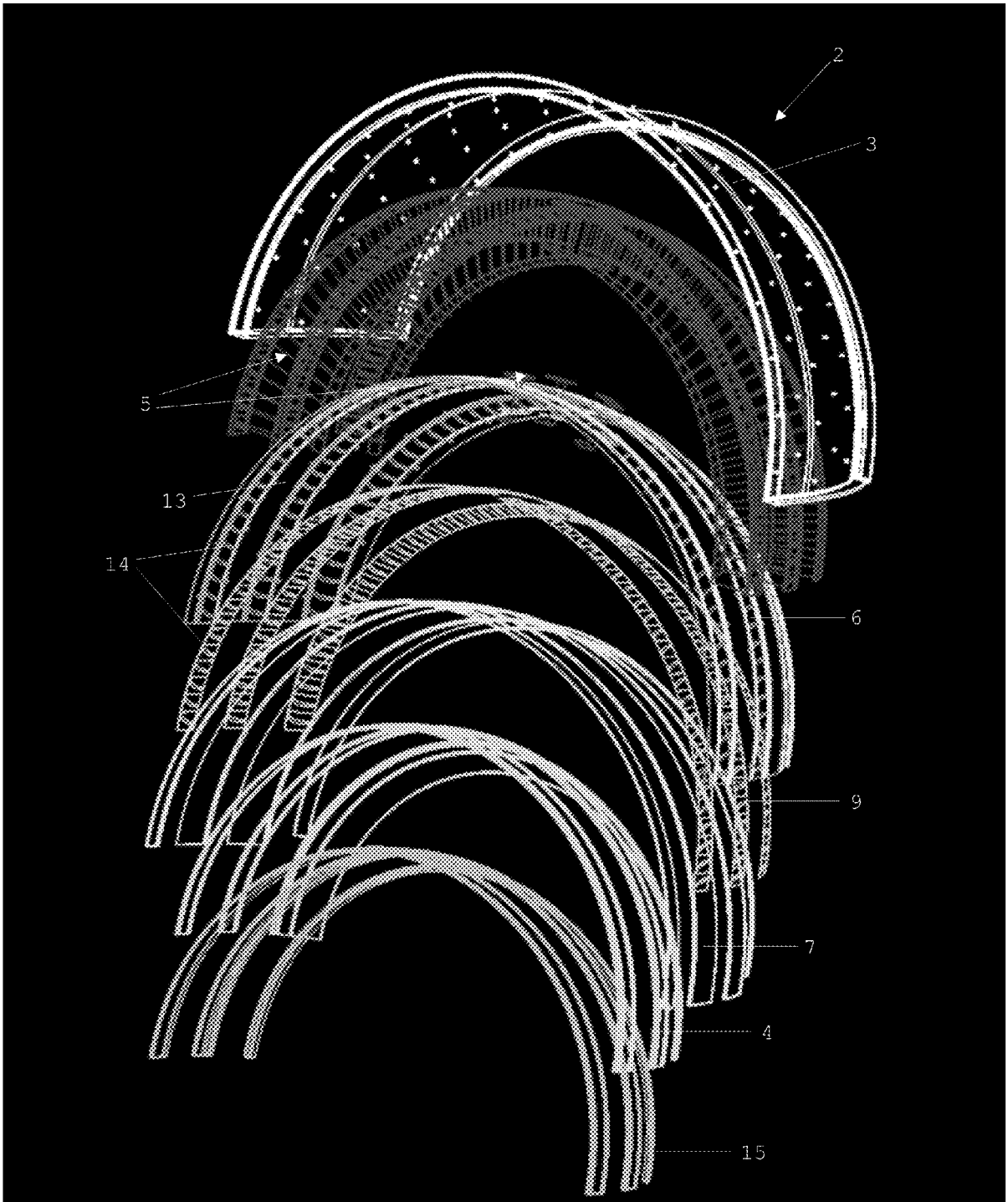
FIG. 4 shows an exploded three-dimensional view of one embodiment of the rectifier as in the invention, built according to a half-shell technology.

The rectifier as in one preferred embodiment of the invention is built according to a multi-stage rectifier architecture via a half-shell technology. A diagrammatic view, a cross-section view and an exploded three-dimensional view of the different elements making up the rectifier as in the invention are shown in FIGS. 2, 3 and 4, respectively. The rectifier comprises the inner collar 4, the outer collar 3, the intermediate piece 6, the stator vanes 5, and the fastening elements 8 to connect the intermediate piece 6 and the outer collar 3. According to the present invention, the stator vane 5 comprises a blade 11 and a blade-head platform 10, and may optionally comprise a blade foot platform.

In a multi-stage architecture, the intermediate piece 6 as in the invention advantageously takes the form of a half-shell incorporating, for example, three rectifier stages as in the examples illustrated in FIGS. 3 and 4, and comprises openings 14 for the passage of the blades 11. The blade-head platform 10 then comes to rest on one side on the intermediate piece 6 while, on the other side, it rests on the outer collar 3. The vane-support 6 also comprises zones 13 arranged between the rectifier stages and intended to receive the abradables 7 usually arranged on the outer collar 3. Preferably, these zones are housings as illustrated in FIG. 2. According to the present invention, the contact between the platform of the vane and the outer collar on the one hand, and between the platform of the vane and the intermediate piece on the other hand, is not necessarily direct. In this way, a shock-absorbing joint 9 may optionally be arranged between the platform of the vane 10 and the vane-support 6 and/or between the platform of the vane 10 and the outer collar 3. Advantageously, the joint 9 is in the form of a half-ring and comprises openings 14 for the passage of the vane blades as illustrated in FIG. 4.

The fastening between the vane-support 6 and the outer collar 3 may be achieved at the level of the abradables 7 as illustrated in FIGS. 2 and 3, and/or at the level of the assembly flanges 12 between the outer collars 3 and/or at the level of the platforms of the vanes 10. It is achieved via fastening elements 8 that may be metal (rivets, lockbolts, bolts, etc.) or composites (e.g. clips, etc.), or by welding.

Optionally, the stator vanes 5 may be rigidly attached to the inner collar 4 by means of fastening elements as previously cited in order to stiffen the assembly by the inner collar and thereby impart increased rigidity to the rectifier (not shown).

The stiffened architecture as in the present invention may comprise stator vanes with different materials and/or geometries. As a result, the stator vanes may be made of a composite or metal material or comprise a mixture of the two.

Likewise, the outer collar and the vane-support may be made of a composite or metal material, respectively.

Advantages of the Rectifier Architecture as in the Invention

This architecture has the advantage of stiffening the stator assembly by their outer collar, the rectifier-support being used to position the rectifiers and maintain them in position (separation of the stiffening and interface/positioning functions). The axial movement along the engine axis is reduced due to the stiffness of the vane-support and of the outer collar. The interest of the device lies in the fact that it is stiffer than a conventional assembly (few or no openings in the outer collar), while being easier to disassemble. It thereby allows to produce rectifiers entirely made of composites, but also allows to interchangeably mount composite or metal vanes, or a mixture of the two. The stiffened architecture as in the present invention not only allows to combine vanes made of different materials, but also vanes with different geometries. The combination of the different vanes can thus be optimized depending on the required functions (aerodynamics, stiffness, mechanical strength).

The stiffened architecture as in the invention comprises fewer fastening elements than a traditional architecture with independent fastening by lockbolts or rivets on each vane.

The rectifiers thus produced save on mass relative to the existing ones, owing to the use of composite materials for the vanes and for the outer collars, and owing to the elimination of a maximum number of fastening elements.

This architecture separates the structural functions ensured by the outer collar from the connection function ensured by the vane-support. This allows better tolerance to damage, the most damaged piece in case of impact (absorption of foreign bodies) then being the vane-support and not the collar. This thereby allows maximal use of composite technologies, the method and the material may be selected to correspond as closely as possible to the requirements for each of the pieces.

The use of an intermediate piece in the form of a half-shell integrating several stages has the advantage that geometric accidents generating over-stresses (openings, abradables) are absorbed by this intermediate (non-structural) piece and not by the outer collar (structural). The outer collar can thus be better dimensioned for fan blade out owing to its simpler geometry. The architecture as in the invention also has the advantage that the outer collar and the collar-support are mounted rigidly relative to each other.

An intermediate piece in the form of a whole ring can only be mounted if the outer collar remains a half-shell because two annular pieces cannot be rigidly assembled without deformation of one or both pieces.

This system, which is easy to assemble and disassemble, promotes aspects of service maintenance while limiting the number of metal fastening elements. A simple replacement is therefore much easier than in the case of the most common current architectures (such as welded titanium assembly).

Lastly, the production cost is limited owing to the limited number of pieces and to easy assembly as well as owing to the detection of non-conformities very far upstream.

The invention claimed is:

1. A turbomachine rectifier comprising a plurality of stator vanes (5) connecting an inner collar (4) to an outer collar (3), each of said vanes (5) comprising a blade (11) and a blade-head platform (10), an intermediate piece (6) arranged between the inner collar (4) and the outer collar (3) and fastened to the outer collar (3), said fastening being entirely outside a circumferential generatrix defined by outer edges of the platform, said intermediate piece (6) comprising openings (14) for passage of the blades (11) and said blade-head platforms (10) resting, on one side, on the outer collar (3) and, on another side, on the intermediate piece (6); and wherein the entirety of the blade-head platform (10) is disposed outside the opening (14) of the intermediate piece (6) such that the blade-head platform (10) is sandwiched between the outer collar (3) and the intermediate piece (6).

2. The rectifier as in claim 1, wherein the intermediate piece (6) is in a form of a half-shell intended to integrate a plurality of stator vane stages (5).

3. The rectifier as in claim 2, wherein the intermediate piece (6) comprises zones (13) arranged between the stator vane stages (5) and intended to receive abradables (7) of the outer collar (3).

4. The rectifier as in claim 3, wherein the intermediate piece (6) is fastened to the outer collar (3) at a level of the abradables (7) and/or at a level of assembly flanges (12) between outer collars (3) and/or at a level of the platforms (10) of the vanes.

5. The rectifier as in claim 4, wherein fastening is achieved by means of fastening elements (8).

6. The rectifier as in claim 4, wherein fastening is achieved by welding.

7. The rectifier as in claim 1, also comprising a shock-absorbing joint (9) arranged between the blade-head platform (10) and the intermediate piece (6) and/or between the blade-head platform (10) and the outer collar (3).

8. The rectifier as in claim 1, wherein the stator vanes (5) are rigidly attached to the inner collar (4) by means of fastening elements (8) in order to impart increased rigidity to the rectifier.

9. The rectifier as in claim 8, wherein the fastening elements (8) are metal or composite.

10. The rectifier as in claim 9, wherein the fastening elements (8) are rivets, lockbolts, bolts or clips.

11. The rectifier as in claim 1, wherein the plurality of stator vanes comprise metal and/or composite stator vanes (5).

12. The rectifier as in claim 1, wherein the plurality of stator vanes comprise stator vanes (5) with different geometries.

13. The rectifier as in claim 1, wherein the outer collar (3) and the intermediate piece (6) are made of a metal or composite material, respectively.

14. A turbomachine comprising a rectifier as in claim 1.

15. A turbomachine rectifier comprising a plurality of stator vanes (5) connecting an inner collar (4) to an outer collar (3), each of said vanes (5) comprising a blade (11) and a blade-head platform (10), an intermediate piece (6) arranged between the inner collar (4) and the outer collar (3) and fastened to the outer collar (3), said intermediate piece (6) comprising openings (14) for passage of the blades (11) and said blade-head platforms (10) resting, on one side, on the outer collar (3) and, on another side, on the intermediate piece (6); and wherein the blade-head platform (10) is disposed outside the opening (14) of the intermediate piece (6) such that the blade-head platform (10) is sandwiched between the outer collar (3) and the intermediate piece (6), the turbomachine rectifier further comprising a shock-absorbing joint (9) arranged between the blade-head platform (10) and the intermediate piece (6) and/or between the blade-head platform (10) and the outer collar (3), and wherein the shock absorbing joint (9) is in the form of a half-ring and comprises openings (14) for the passage of the blade (11).

* * * * *